US007052412B2

(12) United States Patent
Bonneau

(10) Patent No.: US 7,052,412 B2
(45) Date of Patent: May 30, 2006

(54) LOAD TRANSFER ARM FOR PUTTER

(76) Inventor: Michael D. Bonneau, 5831 Algonquin Way, San Jose, CA (US) 95138

( * ) Notice: Subject to any disclaimer, the term of this patent is extended or adjusted under 35 U.S.C. 154(b) by 0 days.

(21) Appl. No.: 10/434,254

(22) Filed: May 7, 2003

(65) Prior Publication Data

US 2004/0224788 A1 Nov. 11, 2004

(51) Int. Cl.
*A63B 53/02* (2006.01)
*A63B 53/04* (2006.01)

(52) U.S. Cl. ..... 473/313; 473/314; 473/340

(58) Field of Classification Search ..... 473/305–315, 473/340–341, 244–255; D21/736–746
See application file for complete search history.

(56) References Cited

U.S. PATENT DOCUMENTS

| | | | | | |
|---|---|---|---|---|---|
| RE19,178 | E | | 5/1934 | Spiker | |
| 2,820,638 | A | * | 1/1958 | Morrison | 473/252 |
| 3,595,582 | A | * | 7/1971 | Chapman | 473/244 |
| D239,402 | S | | 3/1976 | Kindred | |
| D248,783 | S | | 8/1978 | Long | |
| 4,174,108 | A | * | 11/1979 | Reinholz | 473/247 |
| 4,508,342 | A | * | 4/1985 | Drake | 473/204 |
| 4,650,191 | A | | 3/1987 | Mills | |
| 4,795,157 | A | | 1/1989 | Bencriscutto | |
| 4,815,739 | A | * | 3/1989 | Donica | 473/313 |
| 4,824,115 | A | | 4/1989 | Walther | |
| 4,902,015 | A | * | 2/1990 | Nebbia | 473/325 |
| 4,927,144 | A | * | 5/1990 | Stormon | 473/313 |
| 4,999,000 | A | | 3/1991 | Finney | |
| 5,004,237 | A | * | 4/1991 | Antonious | 473/313 |
| 5,211,401 | A | | 5/1993 | Hainey | |
| 5,246,231 | A | | 9/1993 | Antonious | |
| 5,248,145 | A | | 9/1993 | Brown | |
| 5,340,104 | A | | 8/1994 | Griffin | |
| 5,344,149 | A | | 9/1994 | Miller | |
| 5,464,215 | A | | 11/1995 | Koehler | |
| 5,489,097 | A | | 2/1996 | Simmons | |
| 5,494,288 | A | | 2/1996 | Jimenez et al. | |
| 5,577,726 | A | | 11/1996 | Fenton | |
| 5,624,329 | A | | 4/1997 | Schneebeli | |
| 5,655,976 | A | | 8/1997 | Rife | |
| 5,733,203 | A | | 3/1998 | Middleton | |
| 5,755,625 | A | * | 5/1998 | Jackson | 473/314 |
| 5,782,705 | A | | 7/1998 | Solari | |
| 5,782,706 | A | | 7/1998 | DePriest | |
| 5,797,176 | A | | 8/1998 | Rose et al. | |
| 5,816,930 | A | | 10/1998 | Brown | |
| 5,827,130 | A | | 10/1998 | Jimenez et al. | |

(Continued)

*Primary Examiner*—Sebastiano Passaniti
(74) *Attorney, Agent, or Firm*—Schneck & Schneck; Thomas Schneck; David M. Schneck

(57) ABSTRACT

A golf putter is disclosed having a hosel body, including a hosel arm extending over a top surface of a putter head from a hosel connector region of the top surface, which is above a striking area, the striking area having portions that may or may not include a "sweet spot" of the club, in vertical elevation and a hosel having a shaft-receiving aperture and an axis extending obliquely to the hosel arm, at which the hosel arm terminates. The hosel arm extends towards one of two lateral extremities on opposite sites of the hosel connector region. The hosel arm suspends the putter head from the hosel connector region above its striking area in vertical elevation, transferring a load to the hosel connector region.

24 Claims, 4 Drawing Sheets

U.S. PATENT DOCUMENTS 5,857,922 A 1/1999 Delio
5,865,687 A * 2/1999 Alzano ..... 473/313
5,871,407 A 2/1999 Tseng
6,019,686 A 2/2000 Gray
6,080,068 A 6/2000 Takeda
6,110,057 A * 8/2000 McKinnon ..... 473/313
6,213,890 B1 4/2001 Prince
6,319,146 B1 11/2001 Mills
6,354,959 B1 3/2002 Nicolette et al.
6,383,089 B1 5/2002 Bonneau
6,416,421 B1 7/2002 Sery
6,554,720 B1 * 4/2003 Chambers et al. ..... 473/313

* cited by examiner

LOAD TRANSFER ARM FOR PUTTER

FIELD OF THE INVENTION

This invention relates to golf clubs and, in particular, to putters.

BACKGROUND ART

The job of a putter is to strike a golf ball, desirably, with its front face perpendicular to the path of a gentle swing and to cause the ball to roll along on the ground until it falls into the hole. Generally, it is desired that the golf ball be hit by the "sweet spot" of the club. The sweet spot is a specific point on the clubface where the bulk of the weight of the club head is concentrated, or the center of gravity of the club head. It is the preferred spot on the clubface with which to strike the ball because typically, a ball hit on the exact sweet spot will achieve a desired distance and optimum trajectory. Thus, most golfers regard it to be an ideal connection area for the ball. Generally, the sweet spot of the putter is at the center of the clubface or somewhere about equal distance from the toe and the heel. Contact with the ball at the sweet spot typically feels best to most golfers.

There is a wide array of known shapes and designs of putters. The arrangement and design of a putter hosel body and the shaft terminating in the hosel body may affect the golfer's ability to strike the ball at the sweet spot or to achieve desired distance and optimum trajectory. With some putters, when the hosel body and shaft are in alignment with the center of the head, they block a golfer's view during a put. With other putters, the hosel body stems from an end of the club and is thus removed from the center of the club. Such putters may lack the balance necessary to impart the full force of the club against the golf ball. Further, some putters may transmit excessive amounts of vibration to the golf ball. In such cases, the golfer tends to have less control than desired when striking the golf ball.

Several types of putters, with various hosel body and/or shaft designs and arrangements, attempting to overcome problems of the prior art are described as follows. U.S. Pat. No. 5,782,706 to DePriest describes a putter having a head enclosing a weighted mass with an aperture extending from a heel end to a central portion and with a portion spaced from the front edge of the mass for receiving a terminal end of a shaft. The head has a preponderance of the mass at a toe end with the shaft affixed to the heel end.

U.S. Pat. No. 6,319,146 to Mills describes a golf putter in which a front heel face of the putter defines a bore for receiving an end of a hosel body, the hosel body having a substantially right-angled bend, the free end of the hosel body being connected to a shaft. The hosel body is rotatable relative to the bore.

U.S. Pat. No. 6,416,421 to Sery describes a polar balanced putter having a high density material in the toe and head portions and a low density material in the center portions. A hosel body is connected to an end of the putter body by a joint bar.

U.S. Pat. No. 5,494,288 to Jimenez et al. describes a hosel body attached to the back side of the putter blade such that the golfer is able to view the back of the ball.

It is an object of the present invention to provide a new and improved golf putter.

It is a further object to provide a new and improved hosel body and club head for a golf putter.

SUMMARY OF THE INVENTION

The above objects have been achieved with a putter design having a hosel body, including a hosel arm that suspends a putter head from a hosel connector region above its sweet spot or its center of gravity, in vertical elevation. Thus, the bulk load of the hosel body and shaft is transferred to the hosel connector region of the putter. A hosel, defining a shaft-receiving aperture, at which the hosel arm terminates also forms a part of the hosel body. The hosel aperture, for receiving the shaft, has an axis extending obliquely to the hosel arm. The shaft is thus obliquely disposed in the hosel. The hosel arm extends over a top surface of the putter head from the hosel connector region of the top surface towards one of two opposed lateral extremities. The hosel connector region is directly above the sweet spot of the club and a striking area of the club in vertical elevation. Instead of the bulk load being transferred to one of the ends of the putter or regions which do not align with the center of gravity of the putter head, it is transferred to the hosel connector region, due to the placement of the hosel arm.

An increased amount of load from the hosel body and shaft is transferred to the hosel connector region of the top surface of the club at the point at which the hosel arm is connected to the hosel connector region. As stated above, the hosel connector region is above the sweet spot and the striking area in vertical elevation. Therefore, the amount of force transmitted from the hosel body and shaft to the golf ball hit at the sweet spot beneath the hosel connector region in vertical elevation, or hit at the larger striking area, including portions that may or may not include the sweet spot, that is below the connector region in vertical elevation is increased and the force may be more directly imparted to the golf ball. The hosel arrangement of the present invention provides the golfer with a relatively better balanced putter and an improved feel when putting. Therefore, it is relatively easy to achieve desired distance and optimum trajectory when putting.

Further, in one embodiment of the present invention, the hosel arm of the hosel body is elevated from between about ⅛ of a inch to about 4 inches from the top surface. Because the elevation is, relatively speaking, not large, fewer vibrations occur when putting and more of the force from the putter is transmitted to the golf ball instead of dissipating. Thus, the golf ball is hit relatively solidly and directly.

DETAILED DESCRIPTION OF THE INVENTION

Figure 1:
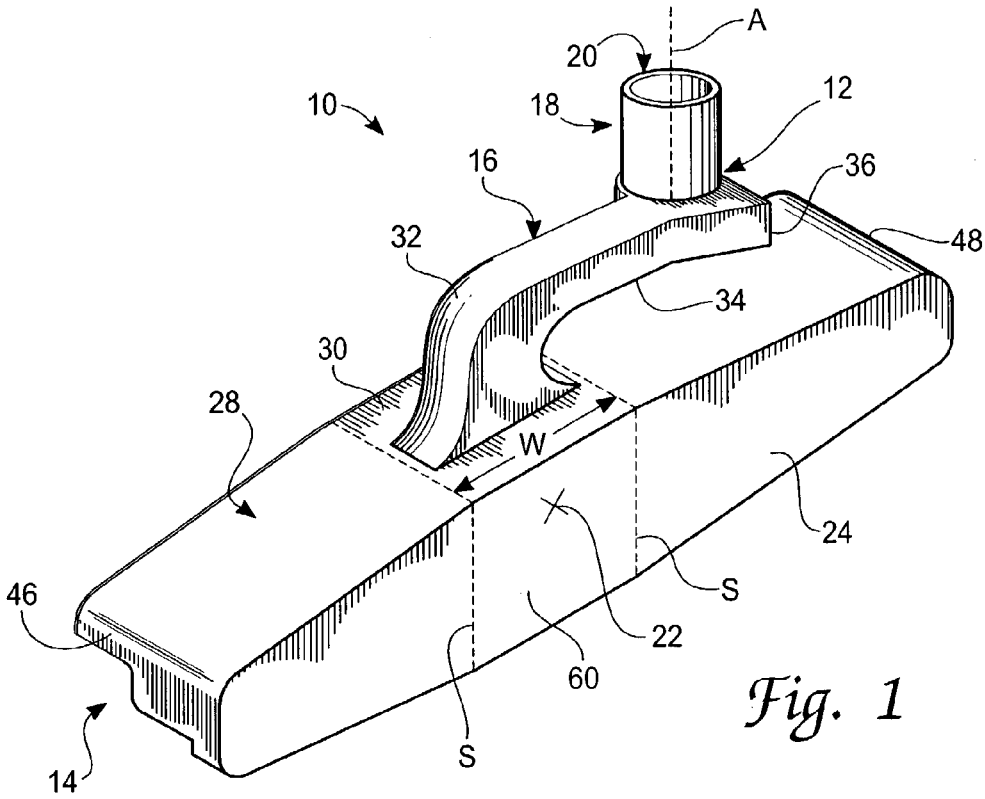
FIG. 1 is a perspective front view of a golf club, without a shaft, including the hosel body and golf club head of the present invention.
Figure 2:
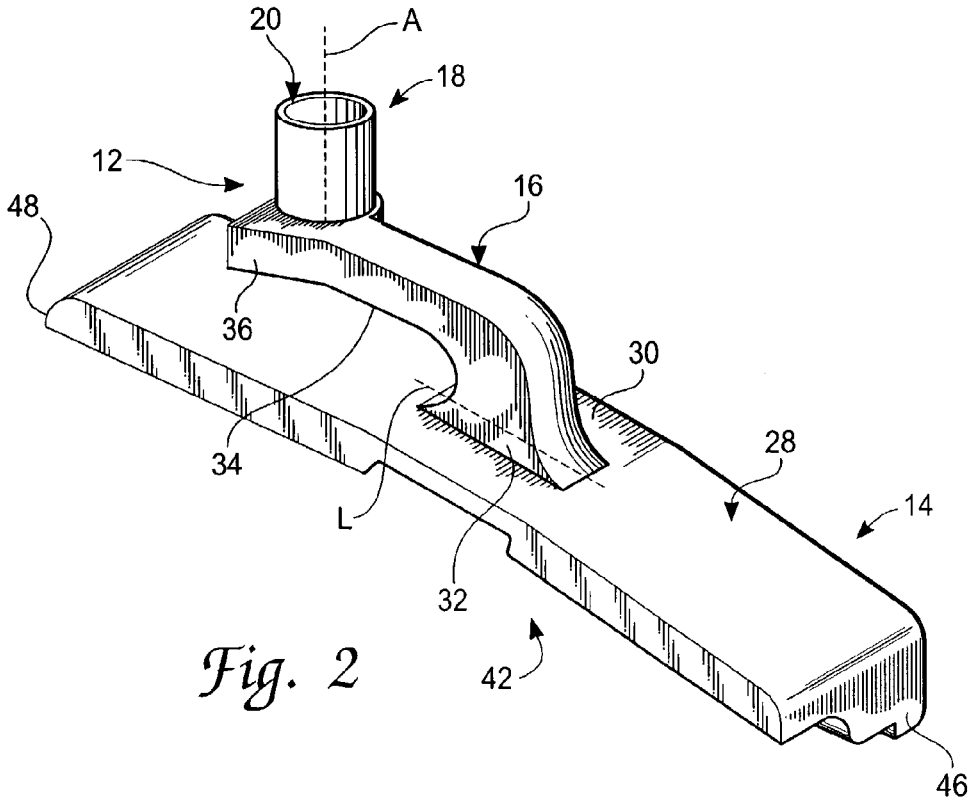
FIG. 2 is a perspective rear view of the golf club of FIG. 1.
Figure 3:
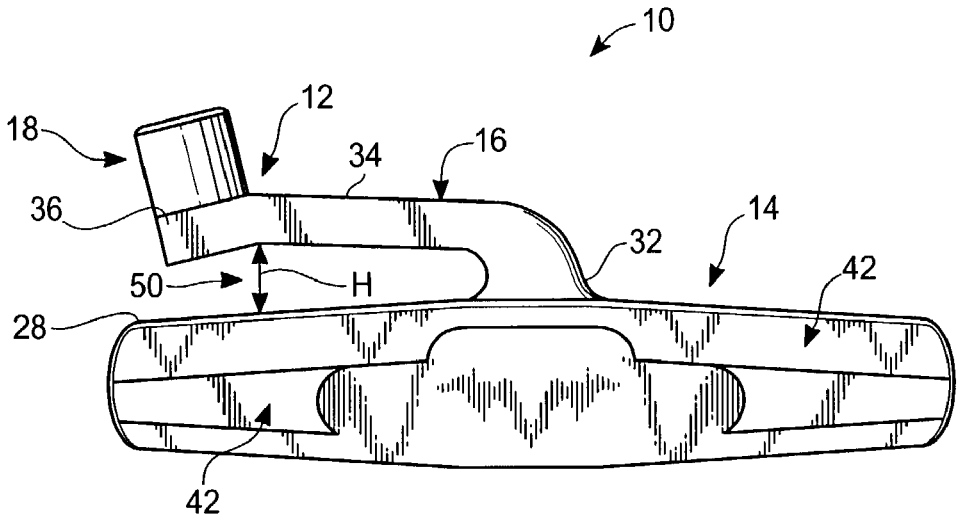
FIG. 3 is a rear view of the golf club of FIG. 1.
Figure 4:
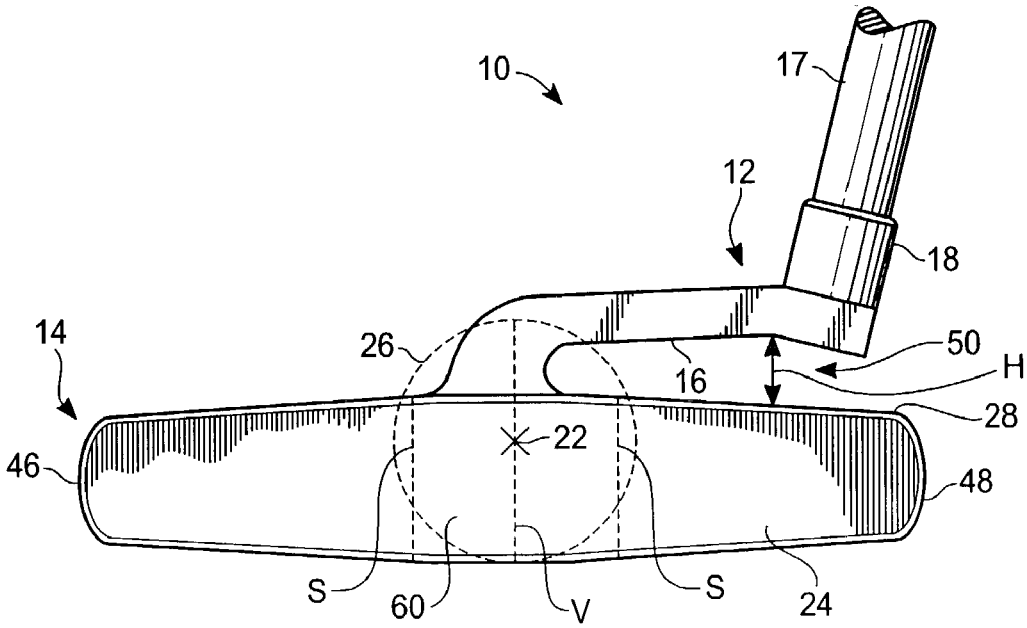
FIG. 4 is a front view of the golf club of FIG. 1 including a shaft portion.

FIGS. 1–3 illustrate a putter 10 including a hosel body 12 and a club head 14 of the present invention. The hosel body 12 includes an elongated hosel arm 16 and hosel 18 defining a shaft-receiving aperture 20. (A portion of shaft 17 is shown in FIGS. 4 and 6.) The aperture 20 has an axis A extending obliquely relative to the hosel arm 16 and to a club head linear axis L. The club head 14 includes a top surface 28 having a hosel connector region 30. The hosel arm 16 is secured to the hosel connector region 30 at one end and connected to the hosel 18 at another end. The hosel connector region 30 may be flat to facilitate fixing of the hosel arm 16 to the hosel connector region however, a flat surface is not required.

With reference to FIG. 4, a "sweet spot" is approximated by the position 22 marked with an X and disposed on a front striking face 24 of the club head 14. The sweet spot 22 is a specific point on the club striking face 24 where the bulk of the weight of the club head is concentrated, or the center of gravity of the club head. It is generally the preferred spot on the club striking face 24 with which to strike a golf ball 26 because typically, a golf ball 26 hit on the exact sweet spot 22 will achieve a desired distance and optimum trajectory. Thus, it may be ideal connection area for the ball. Generally, the sweet spot 22 of the putter 10 is the center of the clubface 24 or somewhere about equal distance from toe and heel regions 46 and 48 of the club 10. In one embodiment, the sweet spot 22 is disposed in the longitudinal center of the clubface 24, an equal distance from the toe and heel regions 46 and 48.

Referring to FIGS. 1–2 and 4, it is seen that the hosel connector region 30 at the club top surface 28 is disposed directly over the sweet spot 22, in vertical elevation. Thus, if the hosel connector region 30 were to be vertically elevated, it would be elevated along the vertical line V, in alignment with and directly above the sweet spot 22.

Figure 5:
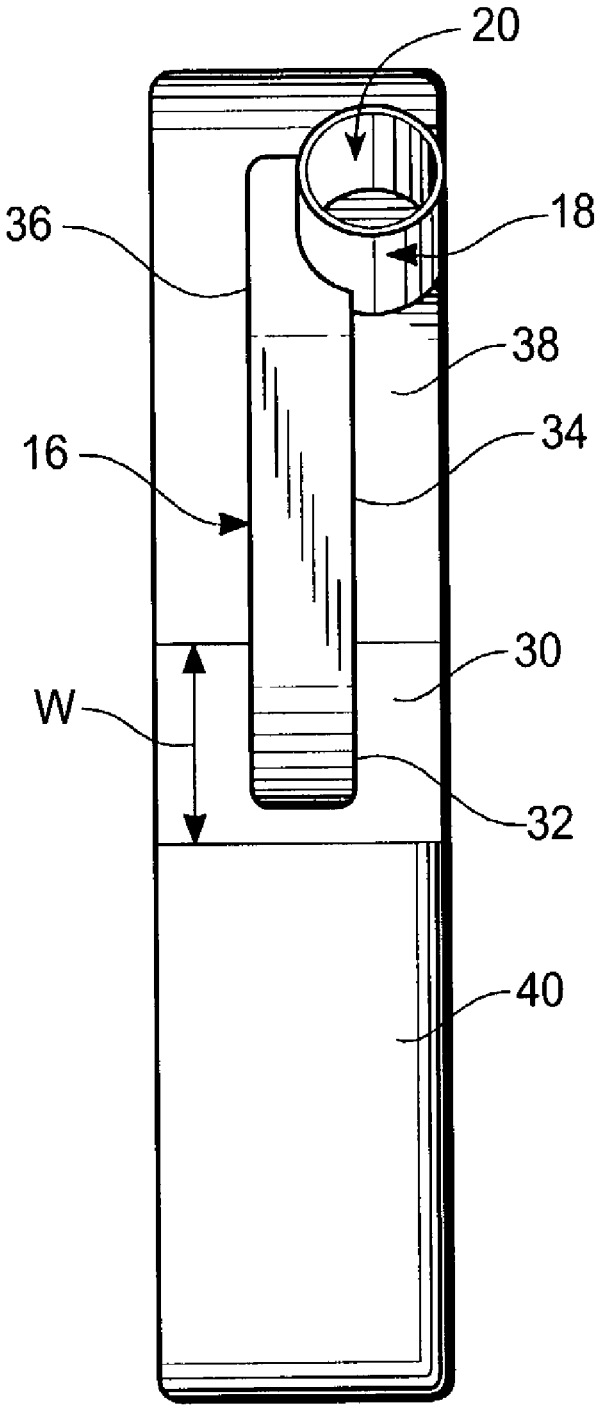
FIG. 5 is a top view of the golf club of FIG. 1.

With reference to FIGS. 1, 4 and 5 it is seen that a striking area 60, delineated by the dotted lines S at the front striking surface 24 of the club 10, is disposed beneath the hosel connector region 30 in vertical elevation. In this example, the striking area 60 has the same width W as hosel connector region 30.

With reference to FIGS. 1 and 2, the hosel connector region 30 is in a center region of the top surface 28. Thus, the hosel arm 18 is secured to the hosel connector region at the center region of the top surface 28. In another embodiment, the hosel arm may be secured to the hosel connector region in a location about equal distance from the toe and heel regions 46 and 48.

As stated above, the hosel connector region 30 is above the sweet spot 22 and striking area 60, in vertical elevation (See FIGS. 1 and 4). Conversely, the sweet spot 22 and striking area 60 are beneath the hosel connector region 30, in vertical elevation. The hosel arm 16 suspends the putter head 14 from the hosel connector region 30. Thus, an increased amount of load from the hosel body 12 and shaft 17 is transferred to the hosel connector region 30 of the top surface 28 of the club head 14. Therefore, an amount of force transferred from the hosel body 12 and shaft 17 to the hosel connector region 30 is transmitted to the golf ball 26 hit at the sweet spot 22 or hit at the striking area 60, on the front face 24, that has portions that may or may not include the sweet spot 22. Thus, the force of the stroke of the club 10 may be increased and the force may be more directly imparted to the golf ball 26 when the golf ball is hit at the sweet spot 22 or at striking area 60.

Referring back to FIGS. 1–3, it is seen that the hosel arm 16 extends, for example linearly, over the top surface 28 of the club head 14 from the hosel connector region 30 towards one of the club head lateral extremities 46 or 48, in a lateral direction. The arm is cantilevered in the direction of a lateral extremity. The hosel arm extends to a region over or approaching one of the club head's lateral extremities. Here, the hosel arm 16 is depicted as extending laterally toward extremity 48. The hosel arm 16 extends in a direction along the linear axis L. In one example, where the linear axis L is longitudinal, the hosel arm 16 or a portion of arm 16, extends in a longitudinal direction. Lateral extremity 46 may be toe region 46 and lateral extremity 48 may be heel region 48. The hosel arm 16 terminates in the hosel 18 defining shaft-receiving aperture 20. In one embodiment, the hosel arm 16 extends a length more than half the distance between a hosel arm base 32 and an end of the heel or toe regions 46 and 48, respectively.

Still referring to FIGS. 1–3, the hosel arm 16 includes the base end 32, connected to the hosel connector region 30, an elevated midsection 34, and an end 36 elevated obliquely with regard to the top surface 28 and disposed obliquely with regard to the elevated midsection 34. The elevated angled end 36 is connected to the hosel 18. The end 36, depicted here, is angled downwardly with respect to the elevated midsection 34 and with respect to the top surface 28. The shaft 17 (FIG. 4) is angled due to the angled orientation of the hosel 18. The shaft 17 and hosel 18 do not block the golfer's view when visually aligning a putt. Further, the base end 32 may serve as a visual alignment site relative to the ball 26.

Referring to FIGS. 1–4, the hosel arm 16 is elevated with respect to the top surface 28 of the club head 14. In one embodiment, the hosel body is elevated, at its highest bottom surface, from a height H ranging from about ⅛ of an inch to about 4 inches with respect to said top surface 28. Therefore, a space 50 is disposed in between the hosel arm 16 and the top surface 28. Because the space is, relatively speaking, not large, fewer vibrations occur when putting and more of the force from the putter 10 is transmitted to the golf ball 26 instead of dissipating. Thus, the golf ball 26 is hit relatively solidly and directly.

With reference to FIG. 5, it is seen that the hosel connector region 30 is in between lateral top surface extremities 38 and 40.

Figure 6A:
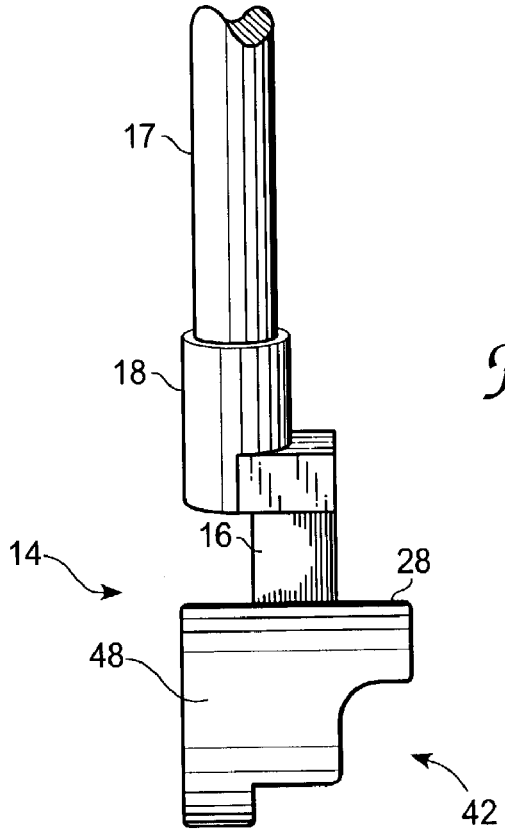
FIG. 6A is a right side view of the golf club of FIG. 4.
Figure 6B:
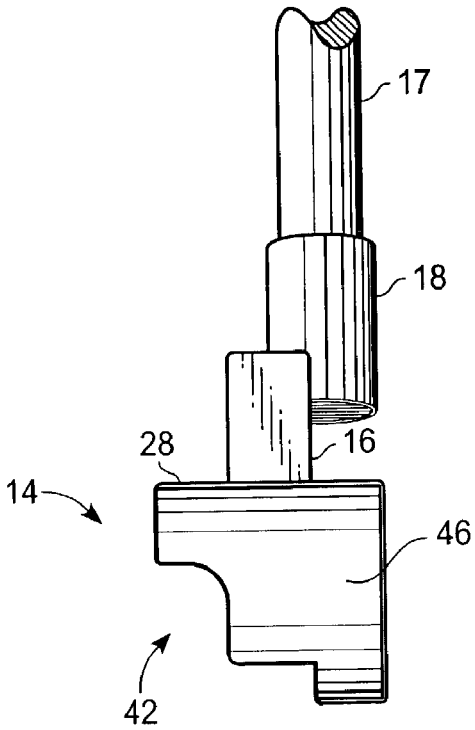
FIG. 6B is a left side view of the golf club of FIG. 4.

With reference to FIGS. 2, 6A and 6B, it is seen that the rear of the club 14 may include a mass relieved regions 42. The club head 14 may include a stepped mass distribution, as described in U.S. Pat. No. 6,383,089, which is hereby incorporated by reference. Alternatively, other desired types of club heads may be incorporated in the present invention. The club head 14 is connected to the shaft 17 by the hosel arm 16 supporting the hosel 18.

What is claimed is:

1. A hosel body and golf club head comprising:

a club head having a sweet spot below a club top surface and a hosel connector region at a top surface of the club directly above the sweet spot in vertical elevation, the head having lateral extremities on opposite sides of the hosel connector region; and an elongated hosel arm extending linearly over the top of the club head from the hosel connector region to a region over or approaching one of the club head lateral extremities and terminating in a hosel defining a shaft receiving aperture, the hosel arm being fixed at one end to the top surface and being suspended above the top surface at an end terminating in said hosel, wherein said hosel arm has an end downwardly angled with respect to said hosel connector region.

2. The hosel body and golf club head of claim 1 wherein said hosel arm is secured to said hosel connector region.

3. The hosel body and golf club head of claim 1 wherein said hosel connector region has a flat surface.

4. The hosel body and golf club head of claim 1 wherein said hosel arm is elevated with respect to said top surface.

5. The hosel body and golf club head of claim 4 wherein said hosel body is elevated to a height ranging from about ⅛ of an inch to about 4 inches with respect to the top surface.

6. The hosel body and golf club head of claim 1 wherein said hosel is connected to said angled end.

7. The hosel body and golf club head of claim 1 wherein said hosel arm is connected to said hosel.

8. The hosel body and golf club head of claim 1 wherein said hosel arm extends a length more than half a distance between said hosel connector region and one of said lateral extremities.

9. The hosel body and golf club head of claim 1 wherein said hosel arm extends laterally.

10. The hosel body and golf club head of claim 1 wherein said club head includes a longitudinal axis and said hosel arm extends along said longitudinal axis.

11. The hosel body and golf club head of claim 1 wherein the aperture has an axis extending obliquely to the hosel arm.

12. A hosel body and golf club head comprising:

a head having a top surface including a hosel connector region, laterally opposed heel and toe regions, and a front striking face;

a hosel defining a shaft receiving aperture; and a hosel arm including a first end and a second end, said hosel arm being connected to said hosel connector region of said top surface at said first end, being spaced apart from said top surface at said second end, and extending in a direction approaching one of said heel and toe regions, wherein said hosel arm includes a midsection disposed between said first end and said second end, said midsection spaced apart from said top surface, wherein said second end is downwardly angled relative to said midsection.

13. The hosel body and golf club head of claim 12 wherein said hosel arm is secured to said hosel connector region at a center region of said top surface.

14. The hosel body and golf club head of claim 12 further comprising a sweet spot on said front striking face wherein said hosel connector region is above said sweet spot in vertical elevation.

15. The hosel body and golf club head of claim 12 further comprising a striking area on said front striking face wherein said hosel connector region is above said striking area in vertical elevation.

16. The hosel body and golf club head of claim 12 wherein said hosel arm is secured to said hosel connector region at a location being about equal distance from the toe and the heel.

17. The hosel body and golf club head of claim 12 wherein said hosel connector region of said top surface is flat.

18. The hosel body and golf club head of claim 12 wherein said midsection is spaced about ⅛ of an inch to about 4 inches from said top surface.

19. The hosel body and golf club head of claim 12 wherein said hosel is connected to said second end.

20. The hosel body and golf club head of claim 12 wherein said hosel arm extends a length more than half a distance between said first end and one of said heel and toe regions.

21. The hosel body and golf club head of claim 12 wherein said hosel arm is connected to said hosel.

22. The hosel body and golf club head of claim 12 wherein said hosel arm extends in a lateral direction.

23. The hosel body and golf club head of claim 12 wherein said hosel aperture has an axis extending obliquely to said hosel arm.

24. The hosel body and golf club head of claim 12 wherein said second end is oblique to said top surface and said hosel arm is connected to said hosel at said oblique second end.

* * * * *